US007740755B2

(12) United States Patent
Wilson et al.

(10) Patent No.: US 7,740,755 B2
(45) Date of Patent: Jun. 22, 2010

(54) FOAM INSERT FOR RAIN GUTTER

(75) Inventors: Geoffrey Howard Wilson, Ottawa Hills, OH (US); Aaron Robert Rasor, Perrysburg, OH (US)

(73) Assignee: Owens Corning Intellectual Capital, LLCDE (US)

( * ) Notice: Subject to any disclaimer, the term of this patent is extended or adjusted under 35 U.S.C. 154(b) by 0 days.

(21) Appl. No.: 12/062,967

(22) Filed: Apr. 4, 2008

(65) Prior Publication Data

US 2009/0249704 A1 Oct. 8, 2009

(51) Int. Cl.
*B01D 35/02* (2006.01)

(52) U.S. Cl. ..... 210/162; 52/12; 52/309.4; 210/163; 210/164; 210/473; 210/483

(58) Field of Classification Search ..... 52/11, 52/12, 16, 309.4, 309.6; 210/162, 163, 164, 210/170.03, 473, 474, 483, 496, 510.1; 428/156–160
See application file for complete search history.

(56) References Cited

U.S. PATENT DOCUMENTS

| | | | | |
|---|---|---|---|---|
| 3,507,396 | A | 4/1970 | Ramsay | |
| 3,855,132 | A | 12/1974 | Dugan | |
| 3,855,134 | A * | 12/1974 | Dugan | 210/455 |
| 3,947,362 | A | 3/1976 | Etani | |
| 4,265,963 | A | 5/1981 | Matalon | |
| RE32,131 | E | 4/1986 | Stahl | |
| 4,592,174 | A | 6/1986 | Hileman | |
| 4,637,383 | A | 1/1987 | Lopez | |
| 4,758,460 | A | 7/1988 | Spicer et al. | |
| 4,841,686 | A | 6/1989 | Rees | |
| 4,949,514 | A | 8/1990 | Weller | |
| 5,103,601 | A | 4/1992 | Hunt | |
| 5,107,635 | A | 4/1992 | Carpenter | |
| 5,242,591 | A * | 9/1993 | Beechert et al. | 210/474 |
| 5,297,367 | A | 3/1994 | Sainz | |
| 5,522,183 | A | 6/1996 | Allen | |
| 5,532,043 | A | 7/1996 | Terashi et al. | |
| 5,536,406 | A | 7/1996 | Silva | |
| 5,595,027 | A | 1/1997 | Vail | |
| 5,842,311 | A | 12/1998 | Morin | |

(Continued)

FOREIGN PATENT DOCUMENTS

| | | |
|---|---|---|
| CH | 661312 | 7/1987 |

*Primary Examiner*—Brian E Glessner
*Assistant Examiner*—James J Buckle, Jr.
(74) *Attorney, Agent, or Firm*—James J. Dottavio; Joan N. Drew

(57) ABSTRACT

A foam insert for a rain gutter for a residential dwelling is provided. The foam insert prevents debris such as leaves, pine needles, gravel, and dirt from entering the rain gutter and permits water to pass through the foam and into the gutter. The foam insert has a channel in the outer side to receive the inwardly projecting lip of a gutter when the foam insert is placed into the gutter. As the foam inserts are installed in the gutter, the lip of the gutter is positioned within the channel. The foam is flexible, which permits the foam insert to be bent and maneuvered into position within the gutter. The foam inserts are formed with a pore size of 14 ppi or below. The foam inserts are inexpensive and may be quickly and easily installed or removed from the gutter by a single individual.

15 Claims, 4 Drawing Sheets

U.S. PATENT DOCUMENTS

| | | | | |
|---|---|---|---|---|
| 5,848,857 | A | 12/1998 | Kilworth et al. | |
| 6,134,843 | A | 10/2000 | Tregear | |
| 6,228,476 | B1 | 5/2001 | Bogrett et al. | |
| 6,293,054 | B1 | 9/2001 | Cangialosi | |
| 6,442,912 | B1 | 9/2002 | Phillips et al. | |
| 6,493,993 | B1 | 12/2002 | Serano | |
| 6,537,446 | B1 | 3/2003 | Sanjuinetti | |
| 6,652,112 | B1 | 11/2003 | Lucarelli | |
| 6,932,911 | B1 | 8/2005 | Groth et al. | |
| 7,048,966 | B2 * | 5/2006 | Thomson | 427/244 |
| 7,200,969 | B2 * | 4/2007 | Rotter | 52/12 |
| 7,208,081 | B2 | 4/2007 | Jones | |
| 7,303,687 | B2 * | 12/2007 | Groth et al. | 210/747 |
| 2002/0122929 | A1 | 9/2002 | Simpson et al. | |
| 2003/0046876 | A1 | 3/2003 | Higginbotham | |
| 2004/0006927 | A1 | 1/2004 | Wickett | |
| 2005/0016078 | A1 * | 1/2005 | Rotter | 52/12 |
| 2005/0034376 | A1 * | 2/2005 | Pourdeyhimi et al. | 52/11 |
| 2005/0145560 | A1 * | 7/2005 | Jones | 210/459 |
| 2005/0178072 | A1 * | 8/2005 | Olthoff | 52/12 |
| 2005/0247611 | A1 * | 11/2005 | Groth et al. | 210/162 |
| 2006/0037253 | A1 * | 2/2006 | Mozeika, III | 52/12 |
| 2006/0096189 | A1 | 5/2006 | Pavlansky et al. | |
| 2006/0117672 | A1 * | 6/2006 | Kurple et al. | 52/12 |

* cited by examiner

FOAM INSERT FOR RAIN GUTTER

TECHNICAL FIELD AND INDUSTRIAL APPLICABILITY OF THE INVENTION

The present invention relates generally to rain gutters, and more particularly, to a foam insert for a rain gutter for residential housing which prevents debris from entering and clogging the gutter.

BACKGROUND OF THE INVENTION

Most residential buildings have rain gutters positioned at the lower edges of the roof to catch rainfall and receive water flowing off the roof. It is not uncommon that these gutters become clogged with debris such as leaves and twigs. When the gutter becomes clogged such that the water cannot flow through the gutter to the downspouts, the rainwater undesirably spills out of the gutter and over the front or back of the building.

Numerous gutter shields and other devices for reducing or preventing the influx of debris into a gutter are known in the art. Non-limiting examples of such gutter shields and debris-reducing systems for gutters are set forth below.

U.S. Pat. No. 5,595,027 to Vail discloses a gutter protector that mounts in the open top of a gutter attached to a roof. The gutter protector includes an elongate sheet of flexible material (e.g., extruded vinyl) that is bent into a curved shape. The curved outer surface extends upwardly above the gutter and prevents large debris from falling into the gutter. Holes are positioned in the flexible material to allow the passage of water. A strip of a tangled mesh of fiberglass is positioned on an inner surface in alignment with the holes to prevent small debris from entering into the gutter.

U.S. Pat. No. 5,848,857 to Killworth, et al teaches a rain gutter shield that includes an elongated, layerless screen of porous, non-woven polymeric fiber material with two elongated semi-rigid ribs on each lateral edge of the screen. A channel is formed in the outside lateral edge of at least one of the ribs and is sized to snap onto the edge of the rain gutter. The header portion of the other rib is used to attach that edge of the rain gutter shield to the roof of the building. As a result, the rain gutter shield has a slanted face which helps to remove leaves and twigs from the surface of the rain gutter.

U.S. Pat. No. 7,208,081 to Jones discloses triangular gutter foam elements that are placed in a roof gutter below the gutter spikes. The foam material is an open pore polyether foam with 10-20 cells per square inch. The gutter foam element is generally in the shape of a right triangle. The hypotenuse side of the triangle defines a void in the lower front portion of the gutter for the passage of rainwater. In operation, rainwater passes though the gutter foam element; however, leaves and other large debris are unable to pass through the foam. Such large debris is blown from the gutter by wind.

Although gutter covers and other gutter systems used to prevent debris from entering into a rain gutter are known in the art, the covers and gutter systems are not as effective as desired. For instance, debris may pass through the holes in the gutter covers and accumulate within the gutter. Additionally, leaves and/or other debris may become entrapped in or on the gutter system, requiring removal of the debris by hand. Some known gutter systems are expensive to manufacture and maintain. As a result, there remains a need in the art for a gutter system that effectively and inexpensively prevents debris from entering and accumulating in a gutter positioned below a roof.

SUMMARY OF THE INVENTION

It is an object of the present invention to provide a foam insert for a rain gutter for a residential building. The foam insert has a generally triangular shape and is constructed of an open, plastic foam with a pore size sufficient to permit the passage of water through the foam insert and into the rain gutter, but small enough to prevent debris from entering into the gutter. The foam insert is flexible, which permits the foam insert to be bent and maneuvered into position within the gutter. Additionally, the foam inserts are inexpensive and may be quickly and easily installed or removed from the gutter by a single individual. Further, the foam insert is weather resistant and maintains its general triangular shape regardless of the temperature or weather condition.

The foam insert includes an upper side, an inner side, an angular side, a bottom side, and an outer side. The angular side extends diagonally from the bottom side to the outer side to provide a void or space within the gutter for the flow of rain water through the gutter. A channel is located in the outer side of the foam insert at a position to receive the lip of a rain gutter when the foam insert is placed into the gutter. The channel may have a length and width substantially equivalent to the upper lip of the gutter. The outer side of the foam insert covers the upper lip, thereby preventing leaves or other debris from being trapped between the foam insert and the upper lip. In addition, the dimension of the bottom side of the foam insert can be reduced to zero so that the angular side connects directly to the inner side of the foam insert, thereby meeting at an apex that would be located at the corner of the gutter corresponding to the intersection of the back and bottom walls of the gutter.

It is also an object of the present invention to provide a combination of a rain gutter and foam insert. The foam insert is sized to extend above the upper lip of the rain gutter. In addition, the foam insert has a general cross-sectional shape of a right triangle and is formed with an upper side, an inner side, an angular side, a bottom side, and an outer side. The foam insert is constructed of an open, plastic foam with a pore size less than or equal to 14 pores per inch (ppi). A channel having the approximate size of the upper lip of the gutter is located in the outer side. The foam insert is positioned within the rain gutter such that the bottom side of the foam insert rests on the bottom wall of the gutter adjacent to the rear wall of the gutter. The upper lip of the gutter is positioned within the channel such that a portion of the foam insert along the outer side is located above and below the upper lip. When the foam insert is positioned within the gutter, the foam insert covers the upper lip of the gutter, thereby preventing leaves and/or other debris from being trapped between the foam insert and the upper lip. The foam insert is securely held in place by positioning the foam insert within the gutter and the positioning of the upper lip within the channel. Because the upper side of the foam insert fills the upper portions of the gutter from the rear wall past the upper lip, the foam insert does not leave a cavity or space along the top of the foam insert between the rear wall and front wall of the gutter that can capture leaves and debris.

It is an advantage of the present invention that the foam insert covers the outer lip of the gutter to prevent leaves and other debris from getting trapped between the outer lip of the gutter and the foam insert.

It is another advantage of the present invention that the foam inserts are inexpensive and may be quickly and easily installed without the need for specialized tools or knowledge.

It is yet another advantage of the present invention that the foam inserts do not require clips or gutter rails to hold the foam insert within the gutter.

It is a further advantage of the present invention that the foam inserts can encapsulate the upper lips of conventional gutters, regardless of the shape of the front wall or the shape of the upper lip.

It is a feature of the present invention that a channel is present in the outer edge of the foam insert to receive the inwardly projecting upper lip of the gutter.

It is also a feature of the present invention that the foam inserts have a general cross-sectional shape of a right triangle.

It is yet another feature of the present invention that the foam insert does not leave a cavity or space along the top of the foam insert between the rear wall and front wall of the gutter that can trap leaves and other debris.

The foregoing and other objects, features, and advantages of the invention will appear more fully hereinafter from a consideration of the detailed description that follows. It is to be expressly understood, however, that the drawings are for illustrative purposes and are not to be construed as defining the limits of the invention.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION AND PREFERRED EMBODIMENTS OF THE INVENTION

Figure 1:
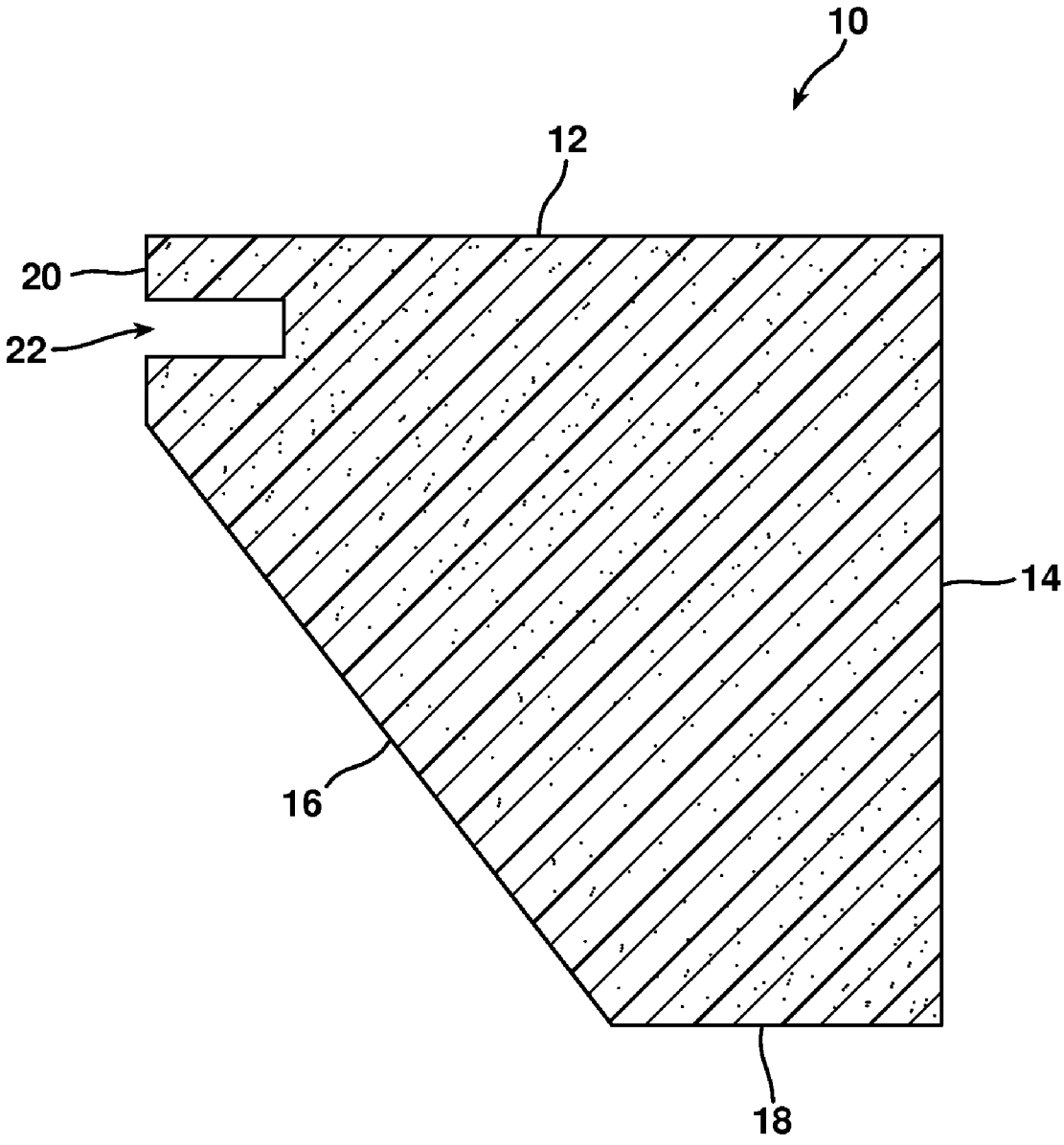
FIG. 1 is a schematic illustration of a foam insert according to one embodiment of the present invention.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein. All references cited herein, including published or corresponding U.S. or foreign patent applications, issued U.S. or foreign patents, or any other references, are each incorporated by reference in their entireties, including all data, tables, figures, and text presented in the cited references.

In the drawings, the thickness of the lines, layers, and regions may be exaggerated for clarity. It is to be noted that like numbers found throughout the figures denote like elements. It will be understood that when an element is referred to as being "on," another element, it can be directly on or against the other element or intervening elements may be present.

The present invention relates to a foam insert for a rain gutter for a residential dwelling or other habitable building. The foam insert has a generally triangular shape in cross section and is designed to be inserted into the gutter away from the eave. A portion of the foam insert extends above the gutter to cover the lip of the rain gutter. The foam insert prevents debris such as leaves, twigs, pine needles, gravel, and dirt from entering the rain gutter, while still permitting water to pass through the foam and into the gutter. The foam inserts are inexpensive and may be quickly and easily installed or removed from the gutter by a single individual.

Referring to FIG. 1, a foam insert according to the present invention can best be seen. The foam insert 10 generally has a cross-sectional shape of a right triangle and is constructed of an open, plastic foam with a pore size sufficient to permit rainwater, and other easily washed-away items such as pollen and dust to pass through the insert 10, but prevent larger debris from entering into the gutter. The foam inserts 10 are formed with a pore size of 14 pores per inch (ppi) or below, and preferably with a pore size from 5 ppi to 14 ppi. In addition, the foam insert 10 may be formed of a polyurethane foam, although other open cell foams are within the purview of the invention. Further, the foam insert 10 is weather resistant and maintains its general triangular shape regardless of the temperature or weather condition (e.g., snow, sleet, rain, wind, etc.).

The foam insert 10 includes an upper side 12, an inner side 14, an angular side 16, a bottom side 18, and an outer side 20. The angular side 16 extends diagonally from the bottom side 18 to the outer side 20 to provide a void within the gutter 30, as will be described in greater detail below. The bottom side 18 is generally parallel to the upper side 12 and is formed by the truncation of the angle between the inner side 14 and the angular side 16. Similarly, the outer side 20 is formed by the truncation of the angle between the upper side 12 and the angular side 16 and is generally parallel to the inner side 14. A channel 22 is located in the outer side 20 at a position to receive the lip of the gutter when the foam insert 10 is placed into the gutter, which is described in detail below. The channel 22 may be formed, for example, by cutting into the foam insert with a knife, a saw, or with a heated blade or hot wire.

Figure 2:
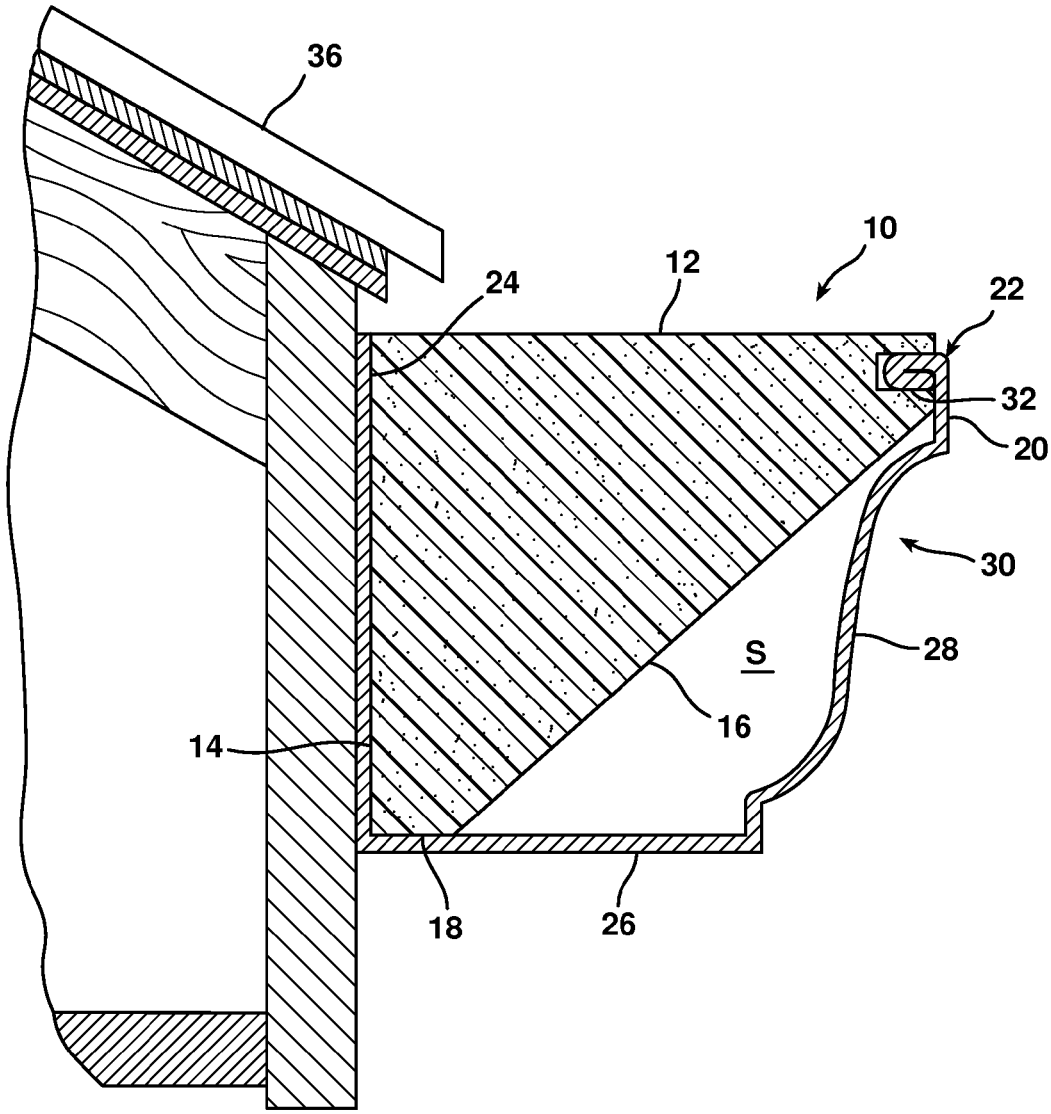
FIG. 2 is an end view of a rain gutter with a foam insert according to the present invention positioned therein.
Figure 3:
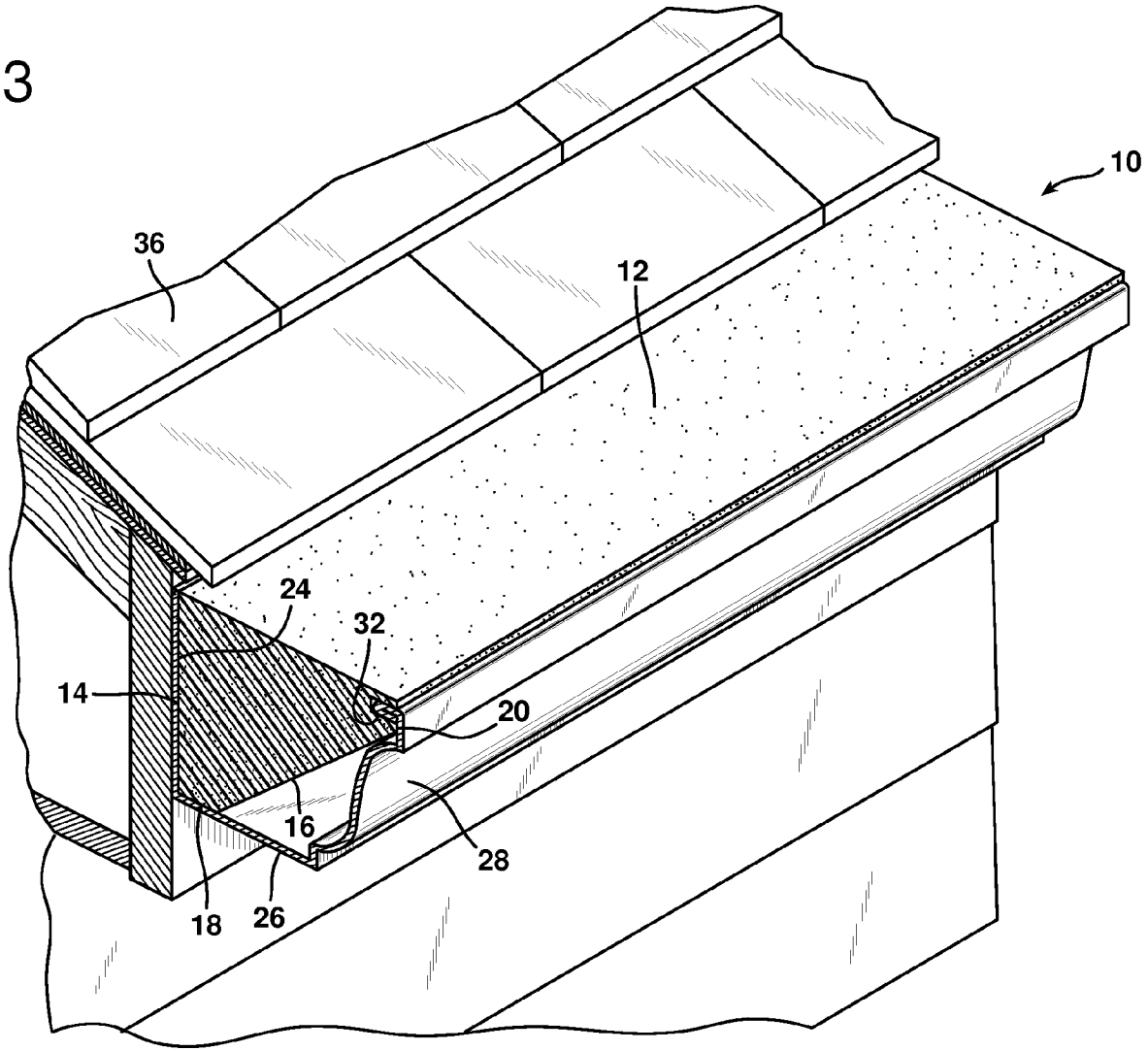
FIG. 3 is a top plan view of a rain gutter containing a foam insert according to the present invention.

The foam insert 10 is inserted into a gutter 30, such as is found positioned on a residential building under the eave or overhang of a roof 36, as illustrated in FIGS. 2 and 3. The gutter 30 may be held in place by a plurality of nails affixing the gutter 30 to the building substructure (not illustrated). The gutter 30 may be any conventional gutter with a rear wall 24, a bottom wall 26, and a front wall 28. Additionally, the front wall 28 of the gutter 30 has an inwardly projecting upper lip 32. The foam insert 10 is sized to substantially fill the gutter 30 with the bottom side 18 of the insert resting on the bottom wall 26 of the gutter 30 adjacent to the rear wall 24 of the gutter 30. The angular side 16 defines a void or space S within the gutter 30 between the front wall 28 and the foam insert 10 for the flow of water along the bottom wall 26. Further, the foam insert 10 is sized to extend above the upper lip 32 with the channel 22 formed in the outer side 20 being positioned to receive the upper lip 32 and help retain the foam insert 10 in place within the gutter 30.

The foam insert 10 is installed in the gutter 30 by placing the foam insert 10 lengthwise in a step-wise fashion into the gutter 30 with the inner side 14 positioned against the rear wall 24 and the bottom side 18 parallel to the bottom wall 26. A sufficient number of foam inserts 10 are placed side by side along the length of the gutter 30 to provide complete coverage of the gutter 30. The foam insert 10 may be formed to have a length of 42 inches, although other lengths for the foam inserts 10 are within the scope of the invention, and thus multiple inserts 10 are utilized within a single gutter 30. Such a length permits installation by a single person. Additionally, the foam inserts 10 may be easily cut to a desired length, such as to fill the space between the last installed insert 10 and the end of the gutter 30.

As the foam inserts 10 are installed in the gutter 10, the upper lip 32 of the gutter 30 is positioned within the channel 22 such that a portion of the foam insert 10 along the outer side 20 is located above and below the upper lip 32. The channel 22 of the foam insert 10 can encapsulate the upper lip 32 of conventional gutters 30 regardless of the shape of the front wall 28 or the shape of the upper lip 32. In addition, the channel 22 may have a length and width substantially equivalent to the upper lip 32 of the gutter 30. As used herein, "substantially equivalent" is meant to denote equivalent or nearly equivalent. The outer side 20 of the foam insert 10 may extend downwardly from the upper side 12 of the foam insert 10 a distance less than half of the front wall 28 of the rain gutter 30. Also, the bottom side 18 covers less than half of the bottom wall 26 of the rain gutter 30. Further, the foam is flexible, which permits the foam insert 10 to be bent and maneuvered into position within the gutter 30. As shown in FIGS. 2 and 3, the outer side 20 of the foam insert 10 covers the upper lip 32, thereby preventing leaves and/or other debris from being trapped between the foam insert 10 and the upper lip 32 of the gutter.

Figure 4:
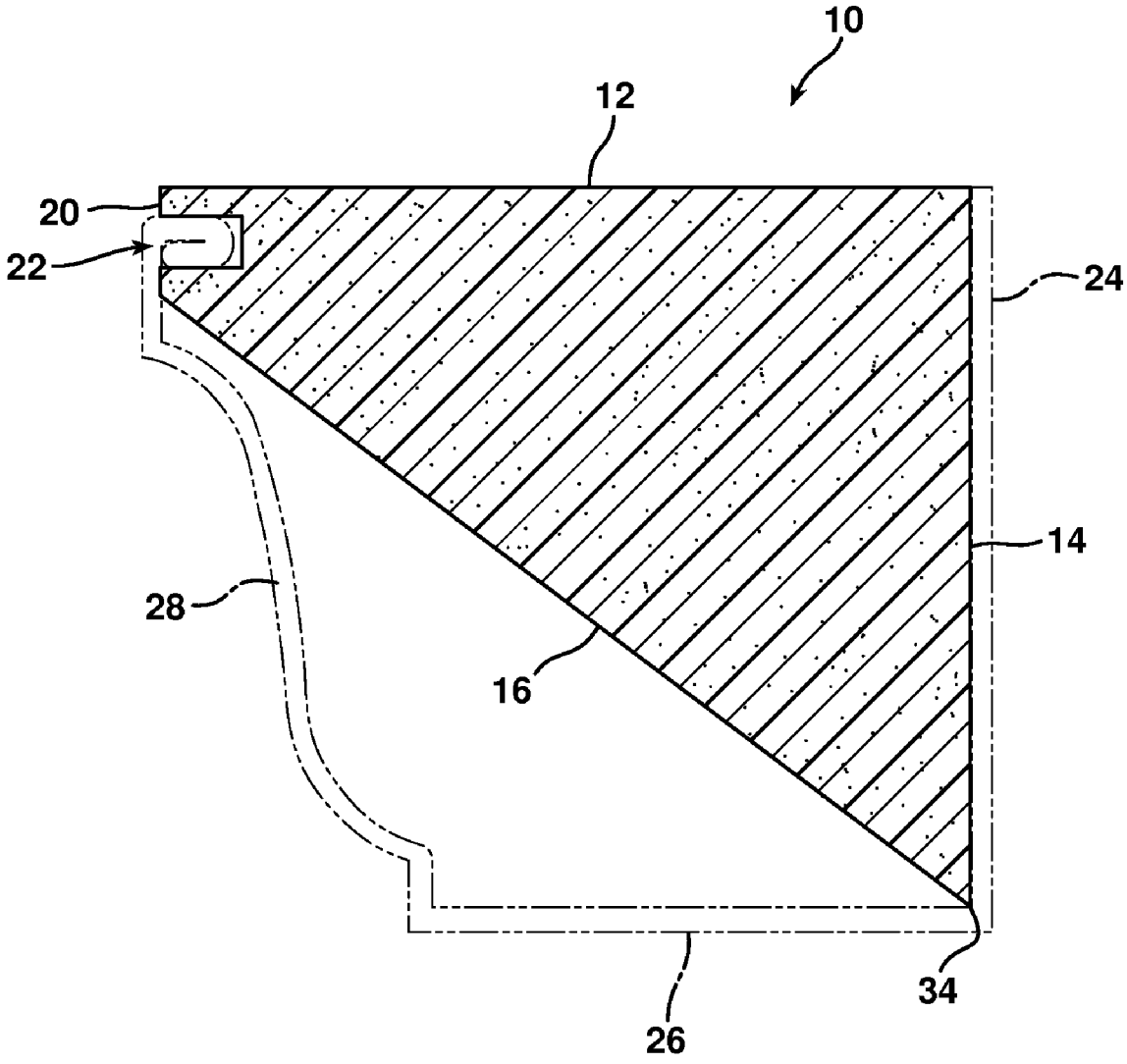
FIG. 4 is a schematic illustration of a foam insert according to another embodiment of the present invention.

The foam inserts 10 may be quickly and easily installed in the gutter 30 without the need for any specialized tools. In addition, with the upper lip 32 of the gutter 30 being trapped within the channel 22, the foam inserts 10 advantageously do not require clips, gutter spikes, or adhesives to hold the insert 10 within the gutter 30. The foam insert 10 is securely held in place by the mere positioning of the foam insert 10 within the gutter 30 and the positioning of the upper lip 32 within the channel 22. One skilled in the art would recognize that the bottom side 18 of the foam insert 10 helps to support the foam insert 10 within the gutter 30, particularly when the foam insert 10 contains moisture from passing water through the bottom wall 26 of the gutter 30. However, it is to be appreciated that the dimension of the bottom side 18 of the foam insert 10 can be reduced to zero, such as is illustrated in FIG. 4, so that the angular side 16 connects directly to the inner side 14, meeting at an apex 34. When such a foam insert 10 is positioned in a rain gutter 30, the apex 34 is located at the corner of the gutter 30 corresponding to the intersection of the rear and bottom walls 24, 26.

In operation, rainwater from the roof 36 flows through the foam insert 10 and into the void or space (S) located within the gutter 30 between angular side 16 of the foam insert 10 and the gutter bottom wall 26 and front wall 28. The water then flows along the bottom wall 26 of the gutter 30 to one or more downspouts (not illustrated), where it is discharged onto the ground. Leaves and other debris that are carried with the rainwater off the roof and that may clog the gutter 30 remain on the top (i.e., on the upper side 12) of the foam insert 10, as the leaves and debris cannot pass through the foam insert 10. Additionally, because the upper lip 32 of the gutter 30 is encapsulated by the channel 22 in the foam insert 10, leaves and other debris cannot wedge between the upper lip 32 and the foam insert 10 and become trapped on the foam insert 10. Further, with the upper side 12 of the foam insert 10 filling the upper portions of the gutter 30 from the rear wall 24 past the upper lip 32, the foam insert 10 does not leave a cavity or space along the top of the foam insert 10 between the rear wall 24 and the front wall 28 that can capture and hold leaves and debris. Accordingly, the leaves and/or debris do not have to hand removed from the foam insert 10.

Due to the porous nature of the foam, the foam insert 10 quickly dries and the leaves and debris may blow off the upper side 12 of the foam insert 10 and away from the gutter 30. As a result, very little, if any, maintenance is required to keep the gutter 30 or the foam insert 10 clean and functional. It is to be appreciated, however, that should the foam insert 10 or the gutter 30 requires cleaning, the foam insert 10 may easily be removed, cleaned, and reinstalled into the gutter 30.

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

Having thus described the invention, what is claimed is:

1. A foam insert for a longitudinally extending rain gutter having a rear wall, a front wall and a bottom wall interconnecting said rear wall and said bottom wall with said front wall including an inwardly extending upper lip, said foam insert comprising:

an elongated foam body having an outer side and an angular side, the angular side extending downwardly and rearwardly from the outer side, the angular side defining a void between said angular side and said front and bottom walls of said rain gutter, the foam body having an upper side that is positioned above said front wall of said rain gutter, said outer side of said foam body being formed with a longitudinally extending channel to receive said upper lip of said rain gutter and to hold said foam body within said rain gutter, wherein an upper portion of said foam body along said outer side of said foam body is above said channel and a lower portion of said foam body along said outer side is below said channel such that said upper lip of said rain gutter is located within said channel between said upper and lower portions, and wherein said foam body allows the passage of water through said foam insert, said foam body restricting debris from entering into said rain gutter and from being trapped between said foam body and said upper lip of said rain gutter.

2. The foam insert according to claim 1, wherein said foam body further includes an inner side positioned against said rear wall when said foam insert is installed in said rain gutter, said inner side extending from said bottom wall of said rain gutter to said upper side of said foam body.

3. The foam insert according to claim 1, wherein said channel has a length and a width substantially equivalent to said upper lip of said rain gutter.

4. A foam insert for an elongated rain gutter having a front wall, a rear wall, a bottom wall, and an upper lip, said foam insert comprising:

an elongated foam body formed of an open cell foam material having a horizontal upper side, an inner side orthogonal to said upper side, an outer side parallel to and opposing said inner side, and an angular side extending diagonally from said inner side to said outer side, wherein said outer side contains a longitudinally extending channel for receiving said upper lip of said rain gutter and for holding said foam body within said rain gutter, said channel dividing said outer side into an upper portion extending above said upper lip and a lower portion extending below said upper lip, said upper lip being positioned within said channel.

5. The foam insert of claim 4, further comprising an opposing bottom side parallel to said upper side, said angular side extending diagonally from said bottom side to said outer side.

6. The foam insert of claim 5, wherein said angular side extends downwardly and rearwardly from said outer side to said bottom side to define a void between said angular side and said front wall and said bottom wall of said rain gutter.

7. The foam insert of claim 5, wherein said channel has a length and a width substantially equivalent to said upper lip of said gutter.

8. A combination of a rain gutter and a foam insert therefore comprising:

a rain gutter having a rear wall, a bottom wall, and a front wall, said front wall having an inwardly projecting upper lip, and an elongated foam body having an angular side extending downwardly and rearwardly from an outer side that defines a void between said angular side and said front and bottom walls of said rain gutter and a top side that is positioned above said front wall of said rain gutter, said outer side of said foam body being formed with a channel to receive said upper lip of said rain gutter and to hold said foam body within said rain gutter, wherein a portion of said foam body along said outer side of said foam body being above and a portion below said upper lip of said rain gutter, and wherein said foam body permits the passage of water and prevents the passage of leaves and debris into said rain gutter and from being trapped between said foam body and said upper lip of said rain gutter.

9. The combination of claim 8, wherein said foam body further includes an inner side positioned against said rear wall when said foam insert is installed in said rain gutter, said inner side extending from said bottom wall of said rain gutter to said upper side of said foam body.

10. The combination of claim 9, wherein said foam insert is positioned in said rain gutter such that said bottom side of said foam insert rests on said bottom wall of said rain gutter adjacent to said rear wall of said rain gutter, said angular side defining a space within said rain gutter between said front wall and said foam insert for the flow of water along said bottom wall.

11. The combination of claim 10, wherein said foam body further includes a lower side that is located against said bottom wall of said rain gutter when said foam insert is installed therein, said bottom side extending forwardly of said inner side such that said angular side extends from said outer side to said bottom side.

12. The combination of claim 11, wherein said bottom side covers less than half of said bottom wall.

13. The combination of claim 12, wherein said channel has a length and a width substantially equivalent to said upper lip of said gutter.

14. The combination of claim 9, wherein said top side of said foam body is elevated above said front wall of said rain gutter to expose debris thereon to the atmosphere to facilitate drying and removal of said debris.

15. The combination of claim 14, wherein said outer side of said foam body extends downwardly from said upper lip for a distance corresponding to less than half of said front wall of said rain gutter.

* * * * *